United States Patent [19]

Peter, III et al.

[11] Patent Number: 4,461,468

[45] Date of Patent: Jul. 24, 1984

[54] AUTOMATIC APPARATUS FOR LIFTING AND SEPARATING SHEET ITEMS FROM THE SURFACE OF AN ELECTROPHOTOGRAPHIC DRUM

[75] Inventors: Emmett B. Peter, III, Orlando; Wilson P. Rayfield, Longwood, both of Fla.

[73] Assignee: Burroughs Corporation, Detroit, Mich.

[21] Appl. No.: 422,292

[22] Filed: Sep. 23, 1982

[51] Int. Cl.[3] ..... B65H 29/56

[52] U.S. Cl. ..... 271/308; 271/33; 271/DIG. 2; 355/35 H

[58] Field of Search ..... 271/33, 118, 282, 307, 271/308, 310, 312, DIG. 2, 314; 355/35 H, 3 TR

[56] References Cited

U.S. PATENT DOCUMENTS

| | | | |
|---|---|---|---|
| 2,032,150 | 2/1936 | Richardson | 271/33 |
| 2,081,386 | 5/1937 | Storck | 271/33 |
| 2,661,289 | 12/1953 | Mayo | 355/3 TR |
| 3,448,979 | 6/1969 | Farmer | 271/33 |
| 3,774,907 | 11/1973 | Borostyan | 271/310 |
| 3,857,560 | 12/1974 | Gundlach | 271/33 |
| 4,092,021 | 5/1978 | Fletcher | 271/176 |

*Primary Examiner*—Bruce H. Stoner, Jr.
*Assistant Examiner*—John A. Carroll
*Attorney, Agent, or Firm*—Carl Fissell, Jr.; David G. Rasmussen; Kevin R. Peterson

[57] ABSTRACT

A rotary, self contained, unitary, modular detack mechanism for cantilever pivotal mounting wherein an epicyclic gear assembly operably connected to a continuously rotating source of motion is caused to advance a portion of adhesive material from a supply to a take-up receptacle over a peripheral projection on the mechanism in timed synchronism with a solenoid actuated cam follower effective to rotate the mechanism concurrently raising and lowering the same into momentary contact with and being detacked, stripper members straddling the mechanism strip the item from the adhesive.

10 Claims, 9 Drawing Figures

AUTOMATIC APPARATUS FOR LIFTING AND SEPARATING SHEET ITEMS FROM THE SURFACE OF AN ELECTROPHOTOGRAPHIC DRUM

BACKGROUND OF THE INVENTION

1. Field of the Invention

The present invention has to do with sheet item, e.g. paper handling, apparatus and, more particularly, with apparatus for separating sheet items from a surface. More specifically the invention has to do with providing automatic means for separating and lifting sheet items from the printing surface of an electrophotographic drum of a copier/printer apparatus.

2. Description of the Prior Art

In printing-duplicating apparatus wherein sheet items are folded or wrapped around a cylindrical or drum-like member during printing-copying it is necessary and required that at some point in time the sheet item be passed to the next station e.g. fuser, stacker, sorter and etc. for further handling. Residual charges remaining due to the effect of the corotrons used with such apparatus produces an electrostatic attraction between the two members causing the sheet item to adhere or to stick to the other member.

Prior art solutions to this problem have included, fixed doctor blades extending across the drum or cylinder acting to peel the item away from the drum. Jets of air have been employed wherein the air blast is directed or aimed at the leading edge of the item between the item and the drum. Vacuum systems have been used to lift the sheet item from a stack and deliver them to the next station. Picker fingers have been used with the ends of the fingers extending toward the leading edge of the paper in order to lift the paper item off the drum, etc.

Rolls of adhesive strip have also been used with the adhesive surface disposed so as to contact the sheet item and then lift the item out of the way or off the drum or cylinder as the case may be. No one of these solutions has been completely effective and each has its own built in restrictions or limitations when applied to other than the specific device for which it was originally designed.

PRIOR ART PATENTS

A search of the prior art has developed the patents listed hereinafter, each relating to the use of an adhesive material and various forms to lift or remove sheet items from a stack or from the surface of an associated piece of hardware. However, as is pointed out hereinafter no one of these patents either singly or in combination shows or describes applicants claimed construction. Thus one of this art is considered to be anticipatory of the combination claimed herein. Nor would applicants apparatus be considered obvious in the light of this prior art.

U.S. Pat. No. 2,032,150 for "Means for Lifting Sheet Material from a Support or Pile", C. Richardson, relates to a container for sheet carbon paper wherein the surface of the cover for the container carries an adhesive spot on one side thereof such that by closing the cover over the top carbon sheet the operator is enabled to pick up a sheet at a time by hand by simply lifting the cover of the package.

U.S. Pat. No. 2,081,386 for "Sheet Feeding Device for Duplicators" F. W. Stork, relates to sheet feeding device for rotary duplicators wherein a gelatin coated fabric sheet is disposed around a rotary cylinder enabling the tacky material of the coating to engage and withdraw sheets singly from a stack for presentation to a duplicating medium.

U.S. Pat. No. 3,406,962 for "Tape Advancing Means" H. Barron, relates to air cylinder means for advancing a tacky adhesive tape from a roll of such tape to a sequencing machine cloth feeder foot so as to pick up plies of cloth one by one and feed them to a sewing station.

U.S. Pat. No. 3,448,979 for "Feeding and Transporting Mechanisms for X-ray Films and Other Sheets", Robert B. Farmer, relates to a pivotal arm mechanism carrying an advanceable adhesive belt movable into and out of contact engagement with sheets of x-ray film for advancing the film from a stack to an x-ray exposure station.

U.S. Pat. No. 3,857,650 for "Adhesive Paper Pickoff System" Robert W. Gundlach, relates to a cartridge containing a supply of adhesive paper which is fed passed a screened window adjacent to the item to be detacked from the photo receptor drum. The mesh of the window screen is sufficiently large to permit the adhesive material to contact the sheet item but is sufficiently small enough to prevent the paper from deforming into the openings of the screen.

SUMMARY OF THE INVENTION

The present invention solves the problems aforestated in a new, and heretofore unobvious manner by providing a self-contained, rotatable, detacking mechanism comprising a circular, rotatable, support member or assembly one side of which is preformed to provide a supply container for a roll of adhesive tape and means for contacting the adhesive surface of the tape with sheet items being moved by the apparatus. The opposite side of the detacking mechanism is provided with a circular cam track or groove engaged by a solenoid actuated cam follower for raising and lowering the detacking mechanism relative to the sheet items. A pivot arm mounts the detacking mechanism for arcuate movement in response to signal energization of the solenoid. A source of continuous rotative motion is coupled to the mounting means and to the detacking mechanism for continuously rotating the latter. Drive means is coupled to the means for contacting the adhesive with the sheet items and to the source of rotative motion effective to rotate the detacking mechanism concurrently advancing the adhesive tape by a calculated but extremely small increment while raising and lowering the entire mechanism relative to the sheet items. An access cover is hinged to the exposed side of the detacking mechanism permitting ease of access for renewing the adhesive roll while preventing the ingressive dust, lint, dirt and other contaminants. The complete mechanism is a modular, unitary assembly except for the solenoid and follower and is coupled to the main drive of the apparatus by means of a pinion gear meshing with the drive gear for the detacking mechanism.

With still more specificity the present sheet item detacking apparatus comprises a two part rotatable assembly including means mounting adhesive material therewithin and means for incrementally feeding the adhesive material across a pressure member for contacting the adhesive with a sheet item traveling at right angles to the detack assembly. The detack mechanism is mounted for rotation on a rockably pivoted arm permitting the detack mechanism to move toward and away from the copying drum while cyclically rotating about its center point. A solenoid actuated cam follower is disposed adjacent the detack assembly so that the follower roller is obliged to follow the cam surface integral with the rotatable portion of the detack assembly effective to cause the rotatable portion to pivot about its pivot point and bring the adhesive material into momentary contact with the sheet item so as to lift the sheet item off of the surface of the copy drum. Incremental advance of the adhesive material from supply to take up is provided by a drive mechanism about which the movable portion of the detack mechanism rotates. The ratio between input and output sides of the drive mechanism enables the adhesive to be advanced in measured fractional increments with each rotation of the overall detack housing assembly.

DESCRIPTION OF THE PREFERRED EMBODIMENT

The present invention comprises a two piece demountable, removable, rotary assembly which is mounted on an irregularly shaped support arm, the latter being pivoted to the main frame of the copier/-printer apparatus with which it is operably associated. A plunger type solenoid actuating member and an attached follower roller arm changes the rotary motion to a rotary-rocking, vertically pivoting movement effective to bring the rotatable assembly into close proximity with the operably associated photo-optical drum from which the copy is to be made.

Figure 1:
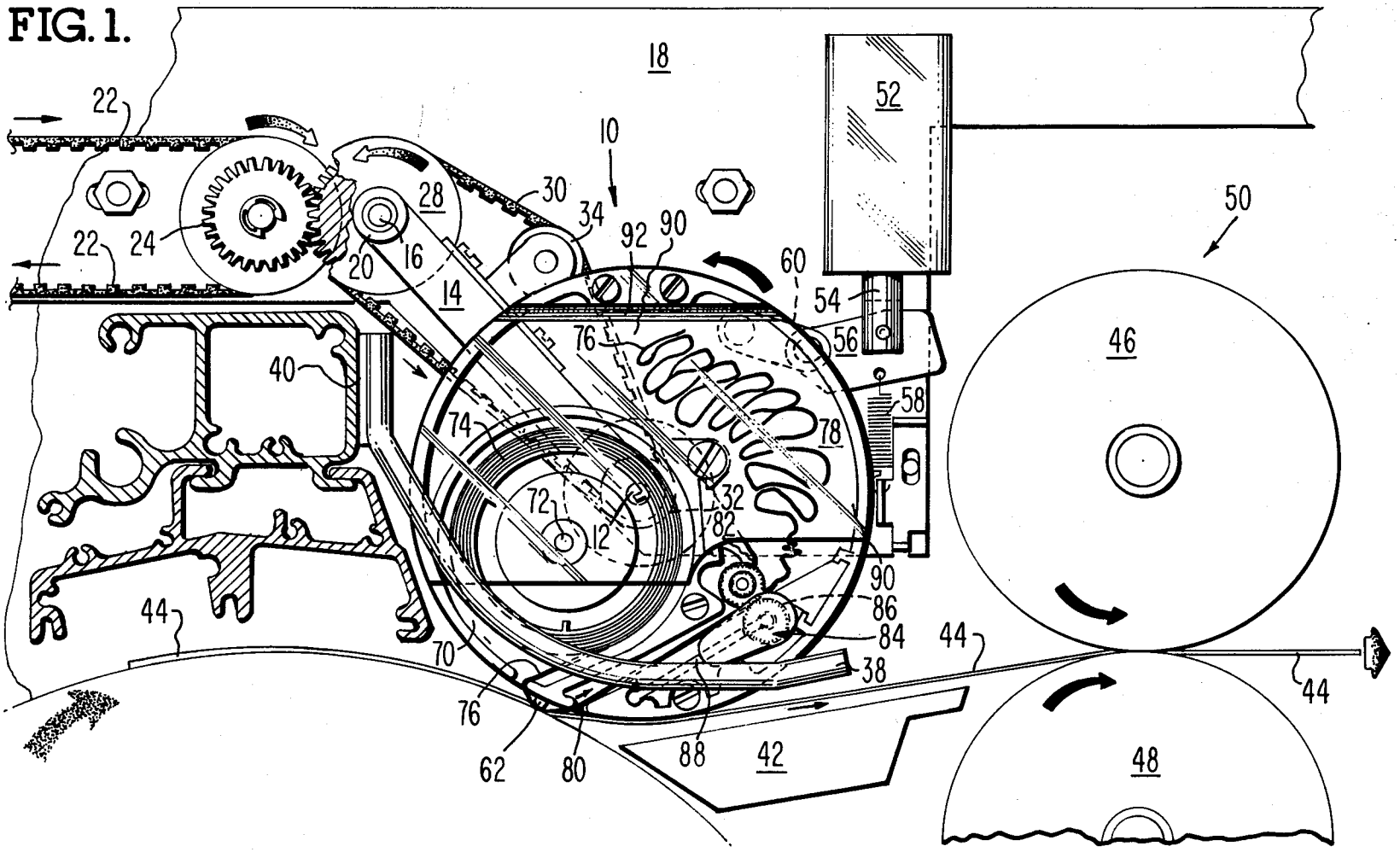
FIG. 1 is a side elevational view (not to scale) of the detack apparatus of the present invention.

As seen first in this side elevational view of FIG. 1, the detack picker assembly 10 is mounted for rotation about a short stub shaft 12 disposed at one end (rightward in FIG. 1) of an irregularly shaped support arm 14. The opposite end (leftward in FIG. 1) of support arm 14 is pivotally mounted to a fixed pivot shaft 16 on an elongated horizontally disposed, demountable, support bracket 18. A rotary bushing or bearing 20 journals the leftward end of arm 14. An input, external drive belt 22 from a rotative source (not shown) rotates input gear 24 in mesh with drive gear 26 for rotating output drive pulley 28 on pivot shaft 16. An output drive belt 30 drives output detack pulley gear 32 over an adjustable tensioning pulley 34. Thus, rotary motion is transmitted to the detack assembly 10, the latter being adapted to be rotated continuously so long as the main drive 22 is energized and moved.

The detack picker assembly 10 is disposed closely adjacent to the photo copy drum 36 of a printer-copier apparatus and is arranged to move between the parallel inboard-outboard paper item lifter arms 38—38 (only the outboard arms being shown) which straddle the assembly 10, as shown. The arms 38—38 are secured at their leftward or rear ends to a bracket 40 mounted to the main frame of the printer-copier apparatus and extend arcuately, forwardly around the detack assembly, and away from drum 36 as shown.

Extending leftwardly, FIG. 1, toward the center line of rotary detack assembly 10 is an air table 42 which acts after the leading edge of the paper item 44 has been lifted by means of the detack picker assembly 10 (under suitable air pressure) to "blow" the paper upwardly as it crosses the plate 42. This causes the leading edge of the paper 44 to enter the nip between rollers 46–48 of a fuser assembly 50 which latter assembly is disposed to the right of the detack assembly 10 and slightly above the print drum 36.

As earlier mentioned herein, the detack assembly 10 operates with a continuous rotary motion but it also is arcuately pivoted vertically up and down about the pivot shaft 16. To effect this pivoting motion a solenoid 52 is secured to the cross bar mounting plate 18 with the plunger 54 of the solenoid vertically movable and interconnected to a rockable cross arm 46 biased by a spring 58 in a downward direction. The leftwardly extending end of arm 56 carries a follower roller 60 which, as will be described in detail hereinafter, rides on a cam surface, not seen in FIG. 1 for alternately raising and lowering the detack assembly 10 relative to the drum 36, for purposes still to be described.

The purpose of the detack picker assembly 10 (among other things) is to assure that the paper item 44 on the drum 36 is carefully lifted off of the drum and passed on to the fuser assembly 50 without surface or other damage to the surface of the drum 36. Thus, as before mentioned, the detack picker assembly is rotatable and is also rockably pivotable about its own pivot axis 16 so as to bring an integral item contacting detack surface projection or knob 62 downwardly onto the surface of the item 44 without in fact touching the surface of the drum 36.

Figure 9:
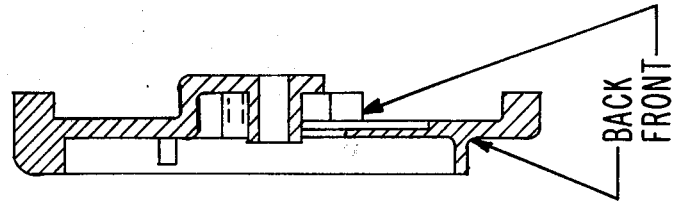
FIG. 9 is a sectional view of the rear element of the two part assembly.

The detack assembly 10, as earlier mentioned herein, is a multipart, demountable, unitary mechanism, as will now be described, comprising two substantially concentric main parts or elements, i.e. a front circular disk-like member 64 FIG. 3 and a rear circular disk-like member 66, FIGS. 7, 8 and 9, the two members being secured together in surface contact by means of a central bolt 68 extending therethrough.

Figures 2, 3:
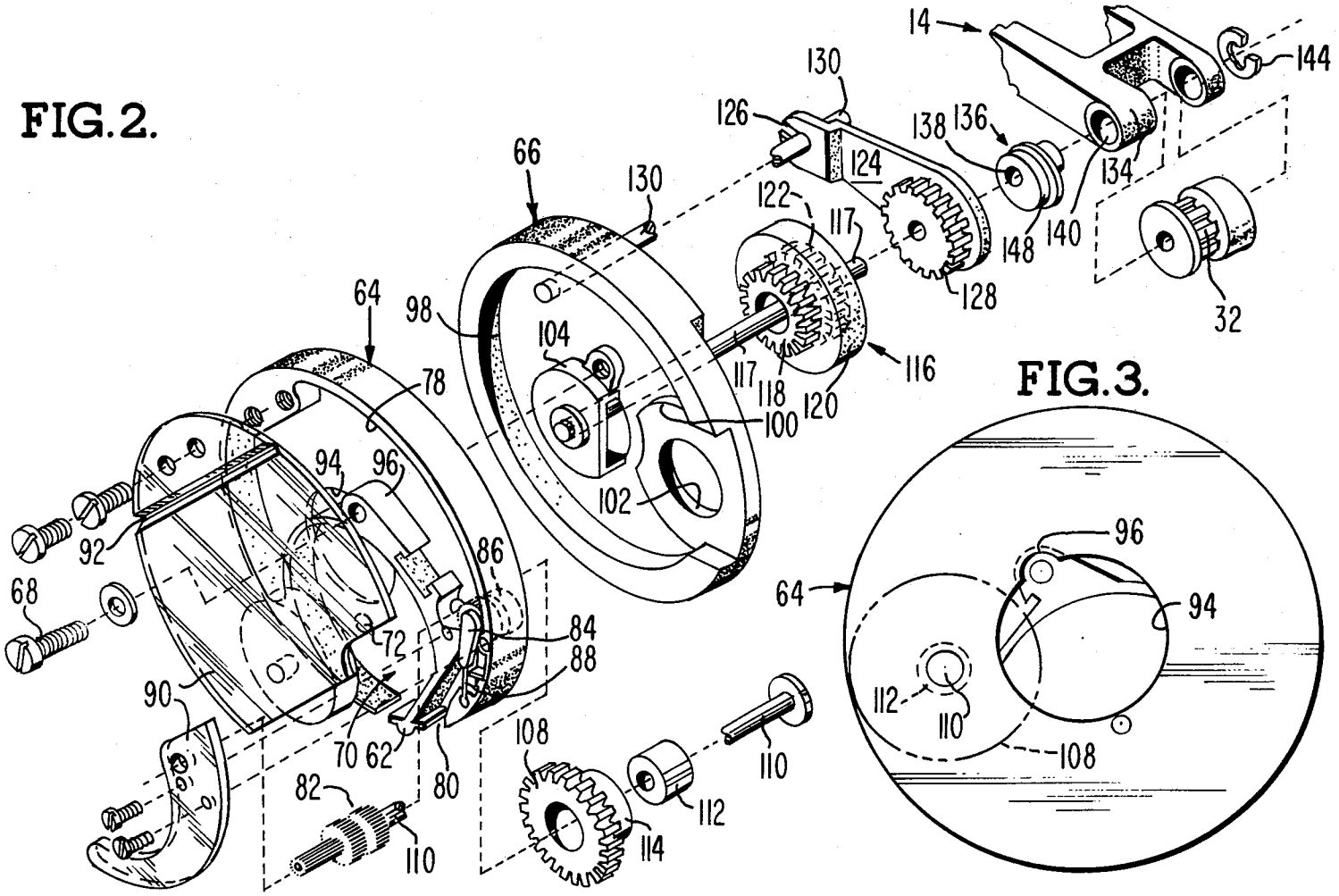
FIG. 2 is an exploded (highly schematic) view of the apparatus of FIG. 1.
FIG. 3 is a detail view of the rear portion of the front element of the two part assembly of the invention.

A circular receptacle 70 FIG. 2 is provided in the face of front disc member 64 including a central opening for receiving the hub of a roll of adhesive material thereon such as one sided sticky tape 74. A central, irregularly shaped spent or used tape receiving receptacle 78 is formed as by casting, milling, etc. surrounding a portion of the receptacle 70 for receiving the used or spent refuse tape 76. The peripheral edge of member 64 includes the integral projection 62 over which the tape is drawn from the supply roll and disposed in the receptacle 78.

In order to ensure suitable tension on the tape as it exits the supply area the tape (FIGS. 1 and 2) is drawn out over the nob or projection 62 and is caused to enter into an elongated channel 80 and thence into the nip between a rotatable knurled tape drive roller 82 and a comb-like structure 84 comprised of a plurality of parallel, spaced apart, knurled wheels 86. Wheels 86 are carried at the end of a spring member 88 adjustably biased into engagement with the drive wheel 82 by means of a set screw (not shown). The exhausted or used tape is then fed at random into the adjacent receptacle 78 for later disposal. A cover 90, hinged at one side, as at 92, provides access to both receptacle 70 and 78 for removal of the spent tape and renewal of a fresh supply roll of adhesive material.

The opposite side of the front disk-like member 64, which is substantially flat, is provided as seen in FIG. 3, with a circular cut-out 94 including an integral orienting member 96 into which mounting bolt 68 is threadedly received as will be explained shortly herein.

Figure 6:
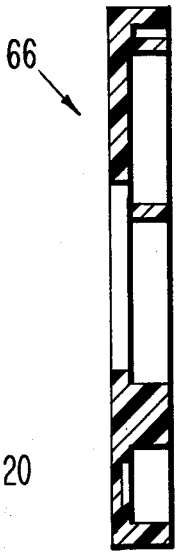
FIG. 6 is a sectional view of the front portion of the two part cam assembly of the present invention.

The rear circular disk-like member 66 FIG. 6 is provided with a large, substantially regular, circular undercut 98 on the inwardly facing surface i.e. the surface facing the rear of the front member 64. A second smaller u-shaped undercut 100 opening outwardly onto the peripheral edge of member 66 together with a clearance aperture 102 effectively provides clearance for additional operating members still to be described herein. An enlarged, central, circular, raised member 104 opposite the opening 102 is provided for interfitting engagement within the circular opening 94 in member 64 as will be described in more detail later on herein. The inner surface of member 66, FIG. 8, is cut, formed, cast, milled etc. to provide a ring like cam surface 106.

Drive means for the tape 74 include an output drive gear 108 rotatably mounted on a short sub shaft 110 slip fitted into a one way clutch member 112, the latter being press fitted into this hub 114 of drive gear 108. Rotatable knurled tape drive wheel 82 FIG. 2 is carried on the exposed end of shaft 110. Gear wheel 108 is rotatable within clearance opening 100 in member 68 and when rotated acts to automatically advance the tape 74 as will become clear hereinafter. Disposed within the recess provided by raised enlarged portion 104 is a compound gear assembly 116 mount on an elongated shaft 117. Assembly 116 is seen to comprise a small output gear wheel 118 integral with and on one side of an enlarged hub 120. Gear wheel 118 drivingly engages output tape drive gear 108. The central internal portion of hub 120 is provided with a larger integral ring gear 122 having 30 teeth. A flanged, irregularly shaped member 124, bifurcated at one end to provide a yoke 126 has an integral gear 128 (having 29 teeth) surrounding a shaft receiving aperture 130 at the opposite end thereof. Gear 126 is rotatably engageable with the ring gear 122 and is adapted to make peripheral contact at only one point in the circumference of the larger ring gear 122 as it is rotated, effectively acting to reduce by a predetermined amount the incremental movement of the tape drive gear 108 with which gear 118 is interengaged. The yoke 124 is adapted to be received over a short post or pin 130 projecting outwardly from the rightward side FIG. 2 of disk member 66.

The earlier referred to irregularly shaped support arm 14 for mounting the assembly 10 to bracket 18 includes a u-shaped mounting yoke 132 at the free (rightward) end thereof. The inboard projection 134 of yoke 132 carries an eccentric bushing 136 the inner aperture 138 of which is concentric with the apertures 140-140 in the projections 134. The outer periphery 142 of eccentric bushing 136 is off center or eccentric with respect to the fixed mounting shaft 117 and is received within the apertures gear members 118, 120 and 128. Pulley 144 secured to shaft 117 is rotated by drive belt 30 rotating shaft 117. A c-ring 146 secures the assembly 16 together on shaft 117 for attachment to the mounting bracket 18.

Figure 4:
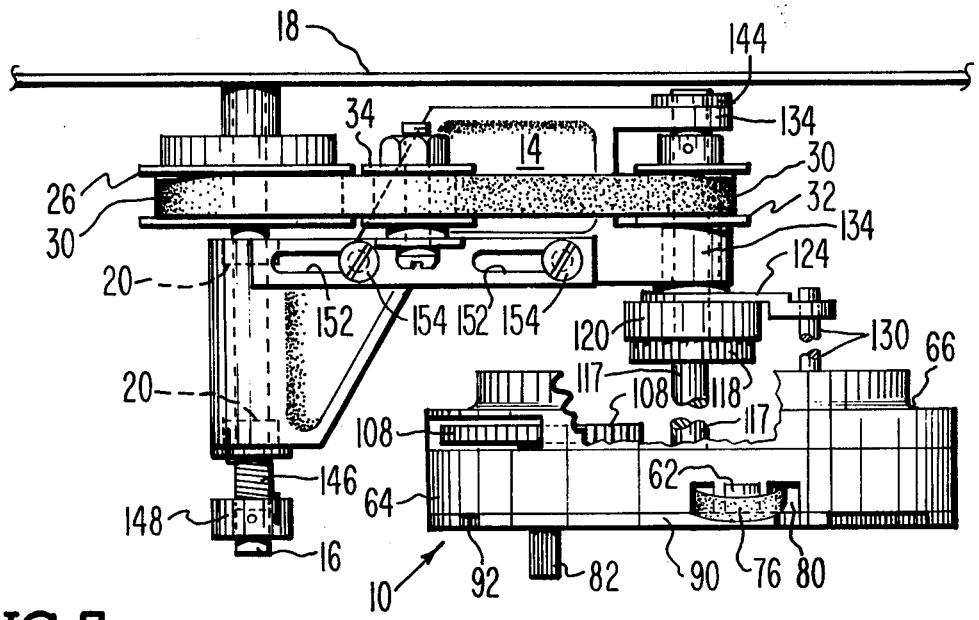
FIG. 4 is a top plan view (not to scale) of the detack mounting structure.
Figure 5:
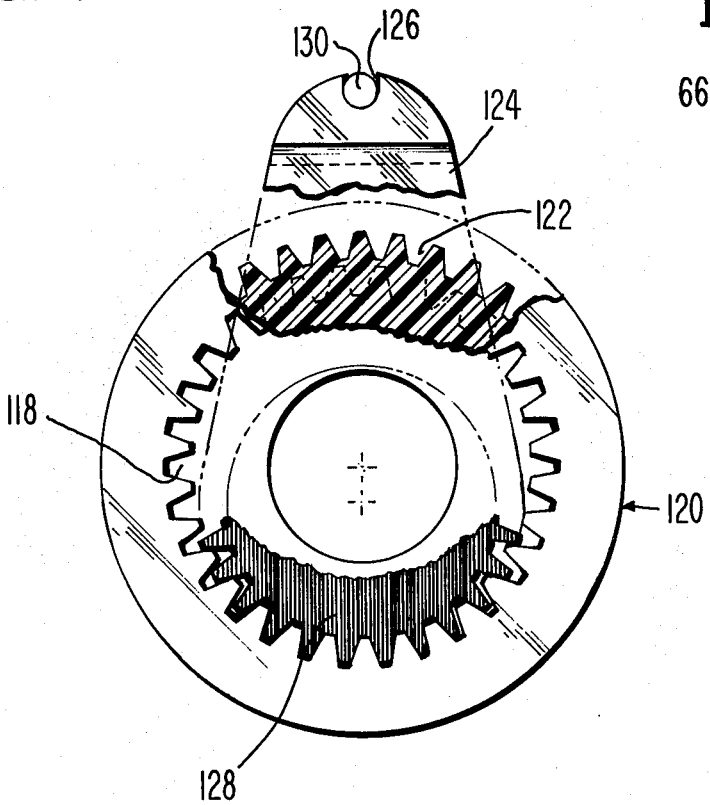
FIG. 5 is a greatly enlarged detail view of the harmonic drive assembly used with the present invention.
Figure 8:
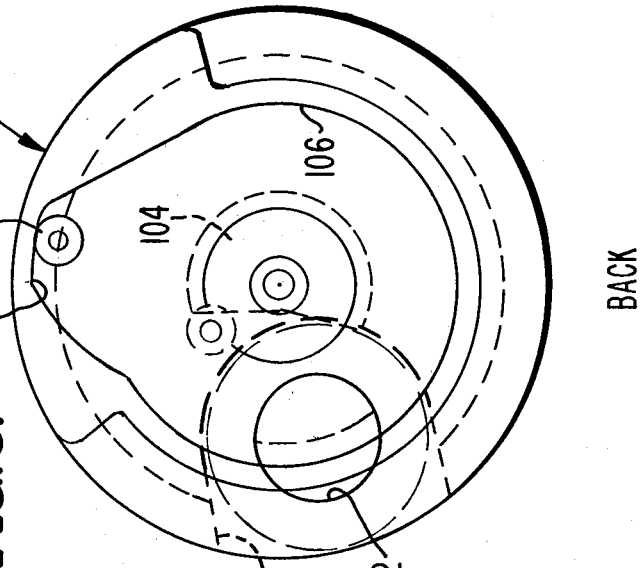
FIG. 8 is a rear view of the rear element of the two part cam assembly.
Figure 7:
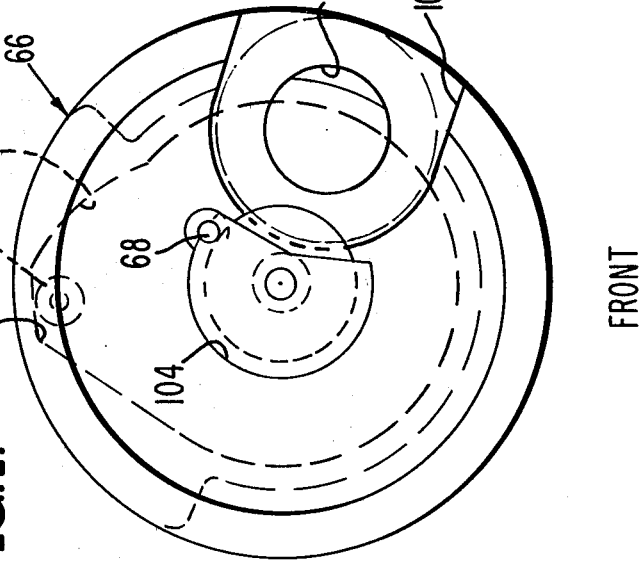
FIG. 7 is a front view of the rear element of the two part cam assembly.

Referring to FIGS. 1, 7 and 8 it is seen that cam follower roller 60 is secured to the outboard end of signal controlled arm 56 attached to solenoid plunger 54 is constrained to engage and follow the surface of cam 106 so that vertical up and down movement can be imparted to the detack assembly 10. A coiled torsion spring 146 FIG. 4 surrounds the terminal end of the mounting pivot shaft 16. One end of spring 146 is secured to the leftward end of support arm 14 while the opposite end of spring 146 is secured to a collar 148 on the outboard end of shaft 16. This arrangement constantly urges the assembly 10 downwardly i.e. toward the drum 36 with which it is operably associated. Tension adjustment for drive belt 30 comprises a rigid member 150 disposed on mounting arm 14 on which idler pulley 34 is rotatably mounted. Horizontal slots 152 permit the pulley 34 to be slid back and forth on arm 14 to provide more or less tension on belt 30. Bolts 154 fix the member in the desired position after adjustment.

OPERATION

As earlier referred to herein, the present mechanism operates to remove a sheet item one at a time, from the surface of a copier drum to which the sheet has adhered electrostatically during the course of the rotary movement of the drum.

Assume that a fresh roll of adhesive tape 74 has been secured within the detac assembly 10 and the rotation of this assembly has been synchronized with the drum rotation.

Drive belt 30 (output from input belt 22) causes assembly 10 to rotate continuously so long as the photo-optical drum 36 rotates. As member 10 rotates it causes member 124 FIG. 2 carrying integral gear 128 (provided with 29 teeth for example) to rotate (walk) around internal gear 122 (provided with 30 teeth) to move by a very slight but definite increment producing a speed ratio of 30:1 at the output gear 108. Shaft 110 coupled through one way clutch 112 to gear 108 carries at its inboard end the knurled wheel 82 which engages knurled wheels 84 between which the adhesive tape is passed into take up area or receptacle 78. Tape 74 is thus adapted to be incrementally fed by wheels 82 and 84 from the supply over member 62 into the receptacle at each rotation of assembly 10.

During rotation of assembly 10 energization of solenoid 52 causes follower roller 60, carried at the end of arm 56, to be lifted vertically, upwardly a sufficient distance so as to cause roller 60 following cam surface 106 to lift the entire rotating assembly upwardly away from drum 36. Continued rotation ultimately brings the low point 156 on cam 106 around into a position where assembly 10 drops momentarily onto the paper FIG. 1 engaging the tacky adhesive surface with a spot on the sheet item 44. Further rotation of member 10 snaps the item 44 off of the drum for passage onto air table 42 and thence to fuser rollers 46–48 of fuser 50.

Under steady printing conditions solenoid 52 is not pulsed; it is held on (energized) and cam 106 in its rotation alternately raises and lowers the detac assembly. In the de-energized condition the detac assembly does not contact the drum although it still moves up and down.

What is claimed is:

1. Rotary apparatus for removing sheet items from a continuously moving surface to which said items are or may be attractively attached, comprising:

rotatable means carrying a demountable, replaceable supply of adhesive material;

drive means for rotating said rotatable means;

epicyclic means operably connected to said drive means for incrementally advancing said adhesive material from said supply to a take-up receptacle into which said adhesive is deposited at random in synchronism with the rotation of said drive means; and signal responsive means for selectively imparting vertical up and down movement to said rotatable means in synchronism with the feeding of said adhesive material effective to bring a portion of said adhesive material into momentary contact with a sheet item so as to lift said item and detack the same from the surface to which it has adhered.

2. The invention in accordance with claim 1 wherein said rotatable means further comprises a multipart disc like assembly including an access cover for constraining said adhesive material against loss while permitting replacement and removal.

3. The invention in accordance with claim 1 wherein said disc-like assembly further includes a peripheral projection over which said adhesive material is withdrawn and advanced, said projection being oriented so that rotation of said disc-like assembly brings the projection carrying the adhesive in to contact with said item.

4. The invention in accordance with claim 3 wherein said disc-like assembly further includes a one way slutch operably coupled to the rotatable drive means and oppositely disposed anti-backup means effective to prevent reverse movement of the adhesive material after being withdrawn from the supply.

5. The invention in accordance with claim 1 wherein said epicyclic means is operably coupled to said rotatable drive means through an eccentric member for imparting eccentric movement to-said epicyclic means..

6. The invention in accordance with claim 1 herein said epicyclic means further comprises a rotatable link one end of which is demountably engable with said disc-like assembly while the opposite end carries a first gear having external gear teeth operably coupled to said drive means, a second gear having internal gear teeth operably coupled to said drive means, and in intermeshing engagement with said first gear, a third gear operably coupled to said second gear and drivingly engaging said means for advancing said adhesive.

7. The invention in accordance with claim 6 wherein said first gear is intergal with said rotatable link and wherein said second gear is integral with said third gear.

8. The invention in accordance with claim 1 wherein said rotatable means includes an integral cam adapted to engage a cam follower operably coupled to said signal responsive means such that movement of said rotatable means is translated by said cam follower into vertical motion.

9. The invention in accordance with claim 8 wherein said rotatable means further comprises two interfitting, circular, plastic members, the front face of one member being provided with means demountably supporting said adhesive supply and including a separate receptacle area adjacent said supply, and wherein said integral cam includes an enlarged, regular circular cam undercut terminating in a small circular area providing a low point for said follower for effecting movement of said rotatable means toward the item being detacked.

10. The invention in accordance with claim 1 wherein said rotatable means is cantilever mounted and further includes a pair of item stripper members adapted to straddle said rotatable means and acting to strip the item from the adhesive material.

* * * * *